US012566011B2

(12) United States Patent
Banger

(10) Patent No.: US 12,566,011 B2
(45) Date of Patent: Mar. 3, 2026

(54) VOLUME DAMPER INSERT

(71) Applicant: Balraj Banger, Guelph (CA)

(72) Inventor: Balraj Banger, Guelph (CA)

( * ) Notice: Subject to any disclaimer, the term of this patent is extended or adjusted under 35 U.S.C. 154(b) by 0 days.

(21) Appl. No.: 18/607,546

(22) Filed: Mar. 18, 2024

(65) Prior Publication Data

US 2024/0318861 A1 Sep. 26, 2024

Related U.S. Application Data

(60) Provisional application No. 63/454,460, filed on Mar. 24, 2023.

(51) Int. Cl.
*F24F 13/14* (2006.01)

(52) U.S. Cl.
CPC ..... *F24F 13/1486* (2013.01)

(58) Field of Classification Search
CPC ..... F24F 13/14; F24F 13/1486
USPC ..... 454/317; 251/308
See application file for complete search history.

(56) References Cited

U.S. PATENT DOCUMENTS 2,134,844 A * 11/1938 Schartow ..... F24F 13/1486 251/308
2,146,142 A * 2/1939 Heasley ..... F23L 13/00 16/229
2,183,292 A * 12/1939 Kerentoff ..... F23L 13/02 16/229
3,722,499 A * 3/1973 Lukjan ..... F23L 13/00 411/401
5,169,121 A * 12/1992 Blanco ..... F24F 13/1426 310/68 B
5,632,304 A * 5/1997 Kempka ..... F02D 9/106 251/308
9,835,354 B2 * 12/2017 Yoskowitz ..... F16K 1/221
2020/0011553 A1 * 1/2020 Waks ..... F24F 7/00
2021/0372656 A1 * 12/2021 Yoskowitz ..... F24F 13/1426

* cited by examiner

*Primary Examiner* — Kevin F Murphy

(57) ABSTRACT

The present invention relates to the Volume Damper Insert Assembly, hereafter called Volume Damper Insert, utilized to regulate and adjust airflow in an HVAC system, as well as the method of its installation in the air supply boot, pipe, or duct of the HVAC system. This Volume Damper Insert can be installed even after the completion of ductwork or construction without damaging the structure. Furthermore, adjusting the position of the damper blade of this volume damper insert does not require access to the wing nut. After installation, the Volume Damper Insert provides ease in adjusting airflow to create a comfortable indoor environment.

10 Claims, 8 Drawing Sheets

VOLUME DAMPER INSERT

FIELD OF INVENTION

This invention relates to the technology and systems used to control indoor climate conditions, including temperature, humidity, air quality, and ventilation, within buildings and vehicles, commonly known as HVAC systems. These systems are designed to create a comfortable and healthy living or working environment by regulating indoor air temperature and quality while ensuring proper air circulation. This invention finds wide applications in vehicles and various construction sectors, including but not limited to residential, commercial, and industrial buildings.

DESCRIPTION OF PRIOR ART

Schartow, U.S. Pat. No. 2,134,544, titled 'Damper and Damper Clip Construction,' discloses a method of attaching a threaded pivot member to the damper blade using damper clips at both diametrical ends of the damper blade. Subsequently, the damper is mounted in the duct by employing two wing nuts. The primary feature of this US Patent proposes a rivet-less damper design.

Kerentoff, U.S. Pat. No. 2,153,629 (Damper Mounting and Regulating), discloses a method for attaching a damper blade using rivets to provisioned plates, which are then affixed to threaded rods at diametrically opposite ends of the damper blade.

Bernal, Publication US No. 2009/0093209, discloses a knob-adjustable volume damper locked by the rotational resistance offered by a flexible rubber O-ring. It has only one duct penetration for installation.

None of the above prior art, known to the inventor of this invention, addresses the main problem faced by Service Engineers/Technicians. However, Inverter attempted to resolve the following issue in his co-pending US Patent Application: US 2023/0024902 A1 published on Jan. 26, 2023, mainly:

1. It was not possible to install a new volume damper without dismantling the ductwork.
2. It was impractical to replace a non functional volume damper.
3. Access to the wing nut was required to set the damper blade position.
4. Air regulation accuracy was very poor.

Below are the distinguishing features of the present volume damper insert compared to the published patent application:

1. Ease in installation.
2. Reduced tools required and associated cost of installation.
3. Reduced installation cycle time.
4. Can be installed in tough to reach installations due to site limitations.

SUMMARY OF THE INVENTION

The volume damper insert of the present invention includes a volume damper assembly, a mounting bracket, and elements of the self-locking mechanism assembly. The volume damper assembly consists of a profiled damper blade and a damper holder securely fixed together using methods such as riveting, welding, or other secure means. The mounting bracket engages with the volume damper assembly through the elements of self-locking mechanism assembly and is designed with a profile to accommodate these components within. The mounting bracket is provisioned with pilot holes or dimples to locate its securing points.

Accordingly, an object of the present invention is to provide ease of installation for volume dampers in both new constructions and retrofit applications in HVAC systems, especially in cases where installing or replacing damaged or catastrophically failed prior art is challenging or impractical.

Another objective of the present invention is to eliminate the need to access the wing nut required in prior art for locking the position of the damper blade.

Another objective of the present invention is to provide a volume damper blade that remains in position without being affected by vibration or stresses in the ductwork.

Another objective of this invention is to provide unmatched air flow regulation accuracy. The unique self-locking mechanism of the current invention helps achieve air flow adjustment accuracy within ±1 CFM of a targeted value without difficulty, thereby achieving an adjustment precision unattainable by prior art embodiments.

Yet another objective of this invention is to provide a volume damper which can be installed without making any major or no changes at, in the HVAC system.

The structure commonly known as duct, carrying the air in an HVAC system can be shaped by a person skilled in the art to accommodate site conditions. However, for simplicity in explanation, we refer to a circular duct as an air pipe; hence the outer geometry of the damper blade is circular in drawings. It's important to note that the invention is equally applicable to the volume damper blades of other shapes, such as rectangular, oval, etc.

These and other objects of the present invention will be more completely disclosed and described in the following specification, the accompanying drawings and the appended claims.

BRIEF DESCRIPTION OF ACCOMPANYING DRAWINGS

DETAILED DESCRIPTION OF THE INVENTION AND ITS PREFERRED EMBODIMENTS

Now the invention is described with reference to the figures. The figures described above are referenced below for the purpose of describing various but not all embodiments of the present invention and are not intended to limit the scope of the present invention.

Figure 1:
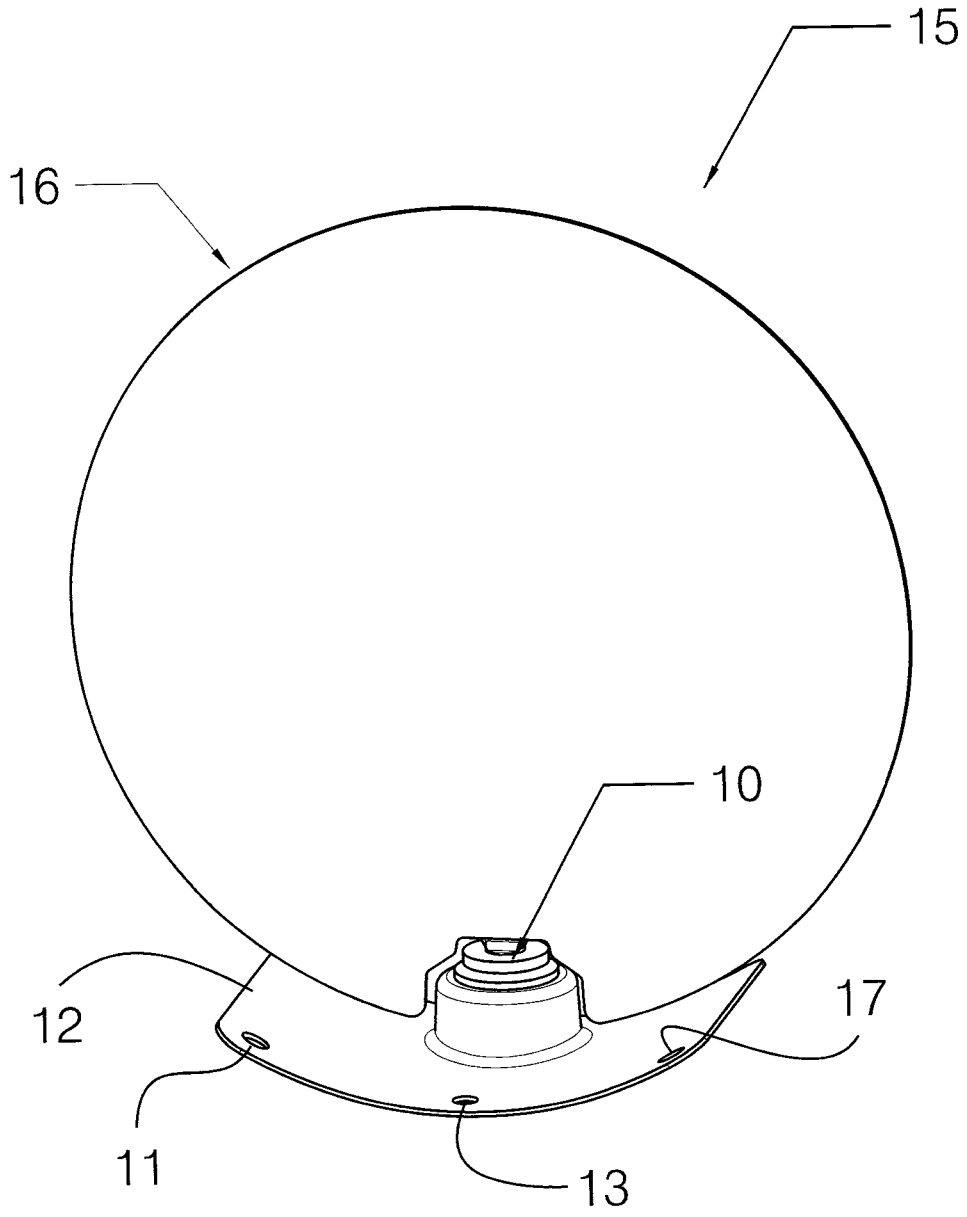
FIG. 1 illustrates an isometric view of the volume damper insert, including the mounting bracket and elements of the self-locking mechanism assembly of the present invention.

In FIG. 1, the volume damper insert 15 comprises a mounting bracket 12, a volume damper assembly 16, and a self-locking mechanism assembly 10. The mounting bracket 12 is equipped with pilot holes 11, 13, and 17 for mounting screws. This complete volume damper assembly, denoted by 15, demonstrates one embodiment of the insert, further details of said embodiment is explained in FIGS. 4 and 5.

Figure 2:
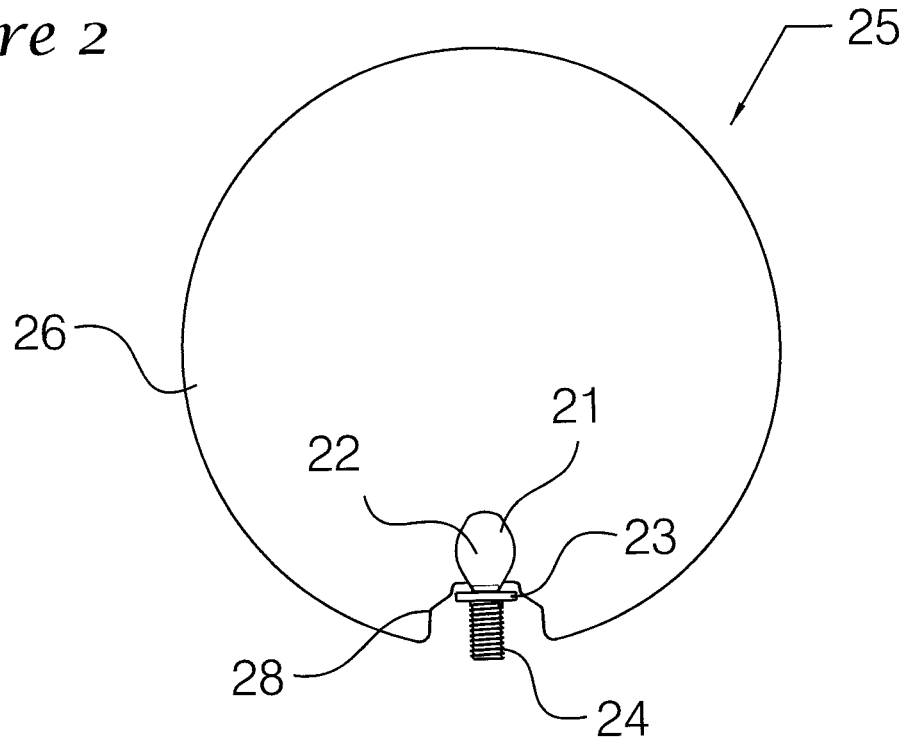
FIG. 2 illustrates a profiled damper blade assembled to the damper holder of the present invention.

In FIG. 2, 25 represent the volume damper assembly, which is created by welding the damper holder 21 to the profiled volume damper blade 26 as shown. The damper holder 21, resembling a bolt, features a flattened welding area 22, a collar 23, and is equipped with a threaded lower portion 24. The volume damper blade 26 features a profile 28 designed to accommodate the elements of the self locking mechanism assembly and the protruded profile of the mounting bracket. Additionally, the profiled damper blade 26 can be secured to the damper holder 21 using any other reliable means. It is understood that the outer profile geometry of the said profiled damper blades 26 is not limited to as illustrated herein those skilled in Art can shape it oval, square and rectangular as per site requirements.

Figure 3:
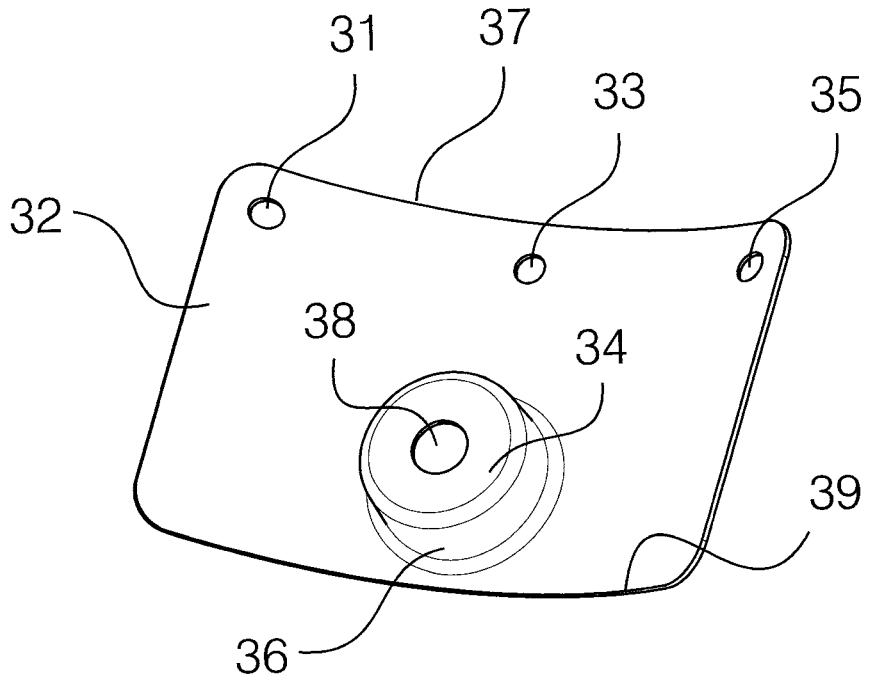
FIG. 3 illustrates an isometric view of the mounting bracket of the present invention.

In FIG. 3, the mounting bracket 32 features a protruded profile 36 close to one of its longitudinal edges 39, and the flat top surface 34 of this profile supports the disc spring. The purpose of the protruded profile 36 to be off-centered is to position the volume damper assembly 25 (FIG. 2) inside the pipe or duct as much as possible during the installation of the volume damper insert 15 (FIG. 1).

The cavity created by the protruded profile 36 accommodates the elements of the self-locking mechanism assembly, such as the spacer and K-lock nut. This protruded profile 36 is equipped with a hole 38 to engage with the threaded lower portion of the damper holder assembly (24/FIG. 2). The profiled mounting bracket 32 is provisioned with holes such as pilot holes 31, 33, and 35 or dimples, near its other longitudinal edge 37. These holes or dimples are designed to guide the mounting screws during the installation of the volume damper insert in an air supply boot, pipe, or duct. The purpose of positioning these holes close to the longitudinal edge is to allow sufficient space for the tool used to screw in the volume damper insert during installation.

Figure 4:
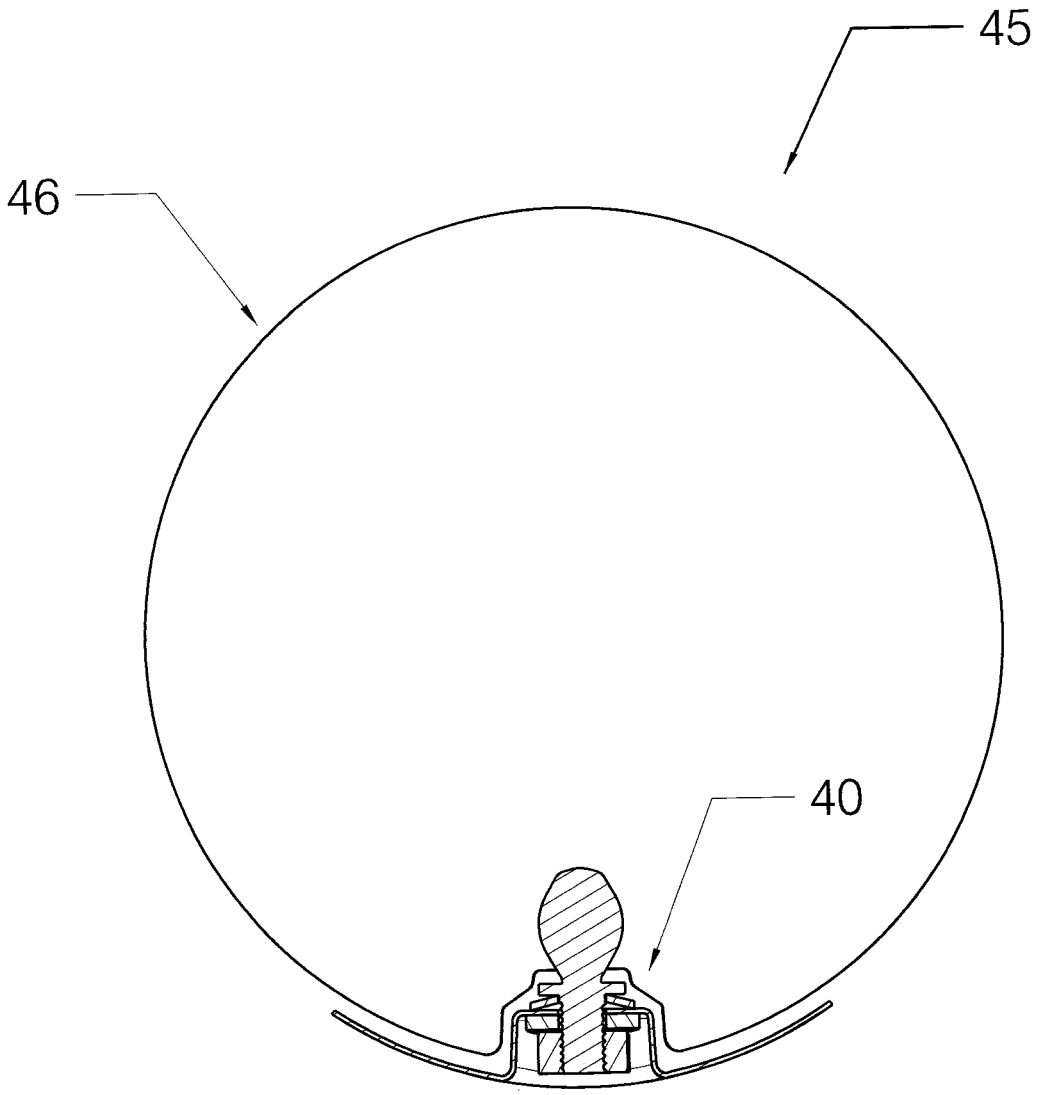
FIG. 4 illustrates a cross-sectional view of the volume damper insert.

In FIG. 4, a cross-sectional view of the volume damper insert assembly 45 is depicted, comprising a self-locking mechanism assembly 40 and the volume damper assembly 46.

To better understand the self-locking mechanism of the volume damper insert, reference will be made to FIG. 5. Said self locking mechanism assembly 55 comprises a volume damper assembly 25 (FIG. 2) and mounting bracket 32 (FIG. 3) and other elements as explained below.

The said self locking mechanism assembly 55 comprises of volume damper assembly 50-1, disc spring 51, a mounting bracket 52, a spacer 53, and a K-Lock nut 54 each engaging the threaded lower portion 57 of the damper holder 50 as shown. After passing through the threads of the damper holder 50, the said disc spring 51 rests in between the top of the protruded surface of the mounting bracket 52 and the collar 56 of the damper holder 50. After the disc spring 51, the threaded lower portion 57 of the damper holder 50 passes through a hole 58 provided in the protruded portion of the mounting bracket 52 for this purpose.

The spacer 53 and K-Lock nut 54 having star washer 54-2 are engaged to the threaded portion 57 of the damper holder 50 through the cavity formed by the protrusion of the mounting bracket 52. The spacer 53, made of plastic material, is included in this assembly to prevent metal-to-metal contact between the mounting bracket 52 and the star washer 54-2 of the K-Lock nut 54, which could lead to jamming due to rusting. However, similar results can be achieved without using the spacer. The spacer 53 is provisioned with a hole for this assembly.

Generally, a K-Lock nut comprises a standard nut with an integrated free-spinning star washer. However, in this specific application, the star washer can be fixed to the nut, effectively locking the spacer 53 to the star washer 54-2 hence the nut 54. The same locking objective can also be achieved by using a separate star washer along with a nut. It should be noted that eliminating the spacer and star washer will achieve the same locking effect for the volume damper assembly, but it may compromise the functionality of the volume damper insert in the long run.

Figure 5:
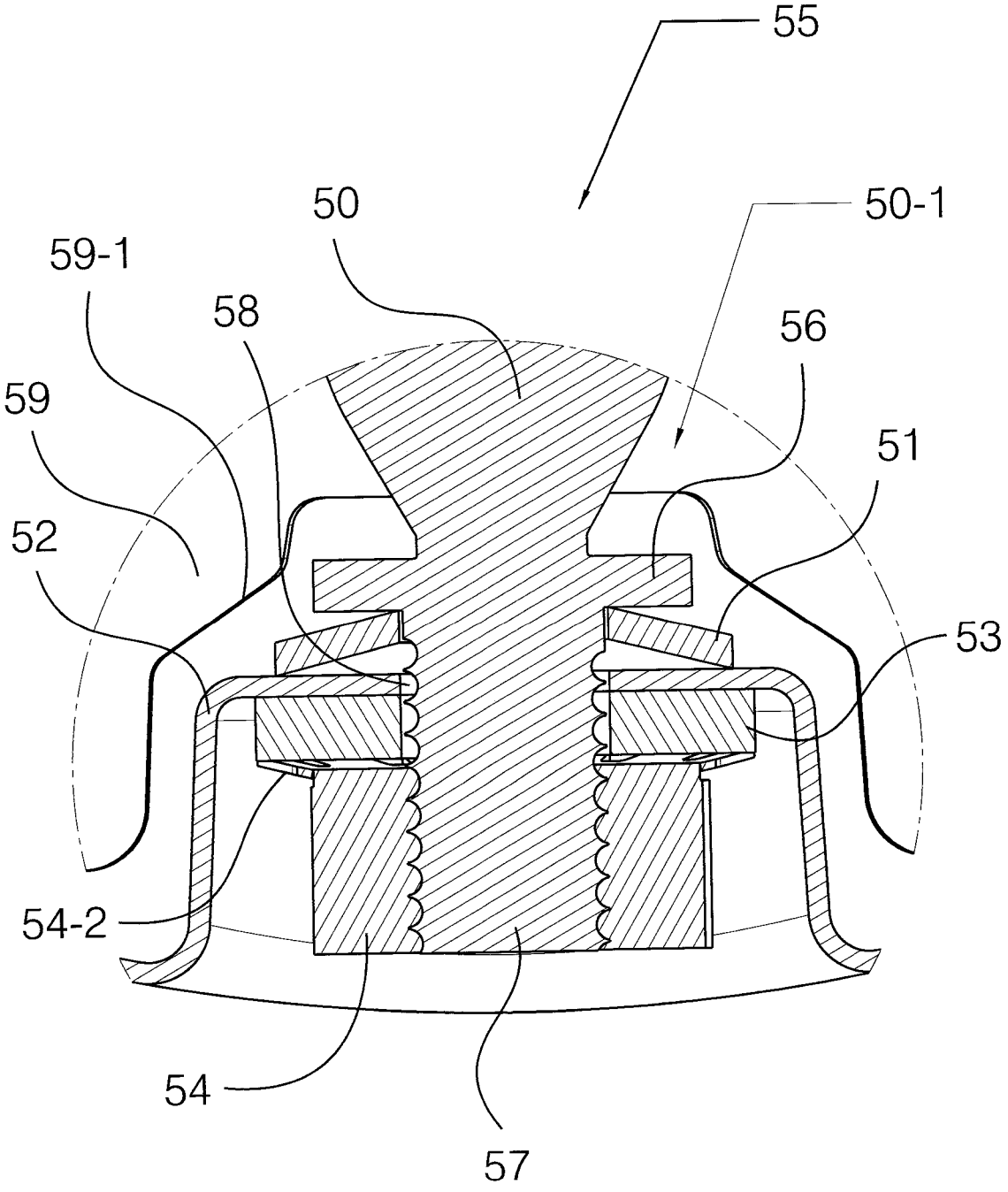
FIG. 5 illustrates in greater detail the cross-sectional view of the elements of the self-locking mechanism assembly of the volume damper insert.

The volume damper blade 59 is designed with a profile 59-1 specifically to accommodate the elements of the self-locking mechanism assembly and protruded profile of the mounting bracket, as shown in FIG. 5. It is worth mentioning that the threaded portion 57 of the damper holder 50 does not extend beyond the surface having pilot holes 31, 33 and 35 (FIG. 3).

The assembly of the damper holder collar 56, mounting bracket 52, spacer 53, and K-Lock nut 54 compresses the disc spring 51 when the K-Lock nut 54 is tightened. This compression of the disc spring 51, resulting from the force exerted through the tightening of the K-Lock nut 54, applies a force on the damper holder collar 56. This force helps prevent unintended movement or rotation of the volume damper assemblies 46 and 56, as depicted in FIGS. 4 and 5 respectively, once they are installed. After tightening to the required torque, the K-Lock nut 54 is secured in place to prevent loosening due to operational stresses or vibration. This can be achieved by using an adhesive such as a thread locking adhesive. Alternatively, the same results can be achieved by welding the K-Lock nut 54 to the threaded lower portion 57 of the damper holder 50. During the tightening of the K-Lock nut 54, the star washer 54-2 intrudes into the spacer 53 which is of soft material, forming an assembly where the spacer 53, star washer 54-2 and K-Lock nut 54 rotate together.

Hence, using these means, the operator can adjust the rotational position of a damper blade to balance the airflow in a system and the position of the damper blade gets automatically locked to the new location. For these adjustments, the damper blade is accessed through the air supply boot.

It is understood that instead of using the K Lock nut 54 and threaded lower portion 57 of a damper holder 50, a slotted damper holder may be used to engage a retaining washer, achieving the same effect without departing from the scope or spirit of the present invention.

Figure 6:
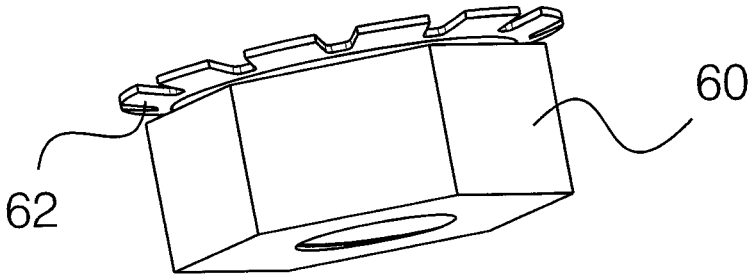
FIG. 6 illustrates a K Lock Nut with a fixed star washer.

In FIG. 6, a preferred embodiment includes the use of a K-Lock Nut 60 having a Star-Washer 62.

Figure 7:
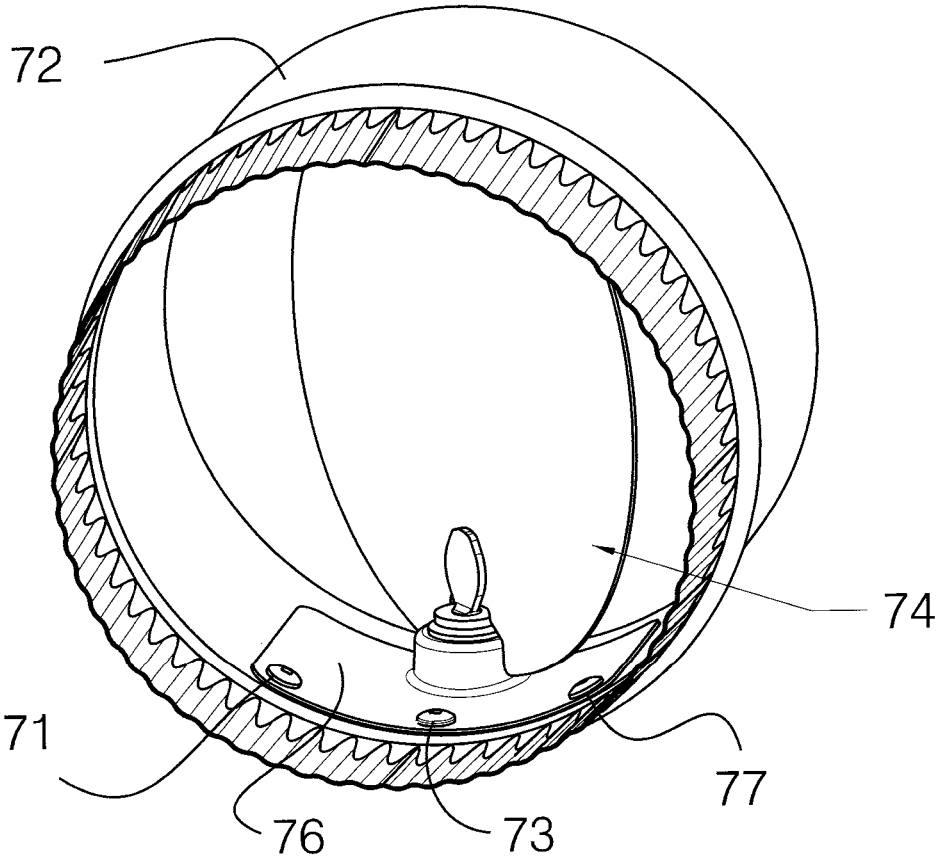
FIG. 7 illustrates an embodiment of the present invention installed in an air supply pipe with the mounting bracket.

In FIG. 7, another embodiment of the present invention is depicted as mounted in an air supply pipe. The components shown include mounting screws 71, 73, and 77, air pipe 72, volume damper assembly 74, mounting bracket 76, and other related elements.

Figure 8:
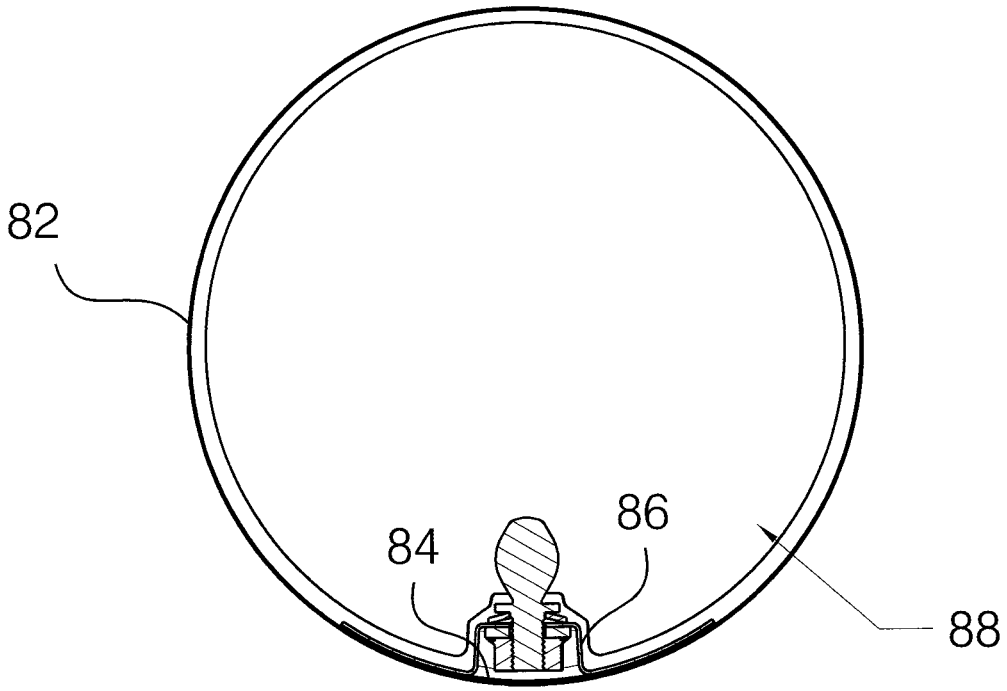
FIG. 8 illustrates a cross-sectional view of another embodiment of the volume damper insert, which includes the mounting bracket and adhesive tape for installing in an air supply pipe.
Figure 9:
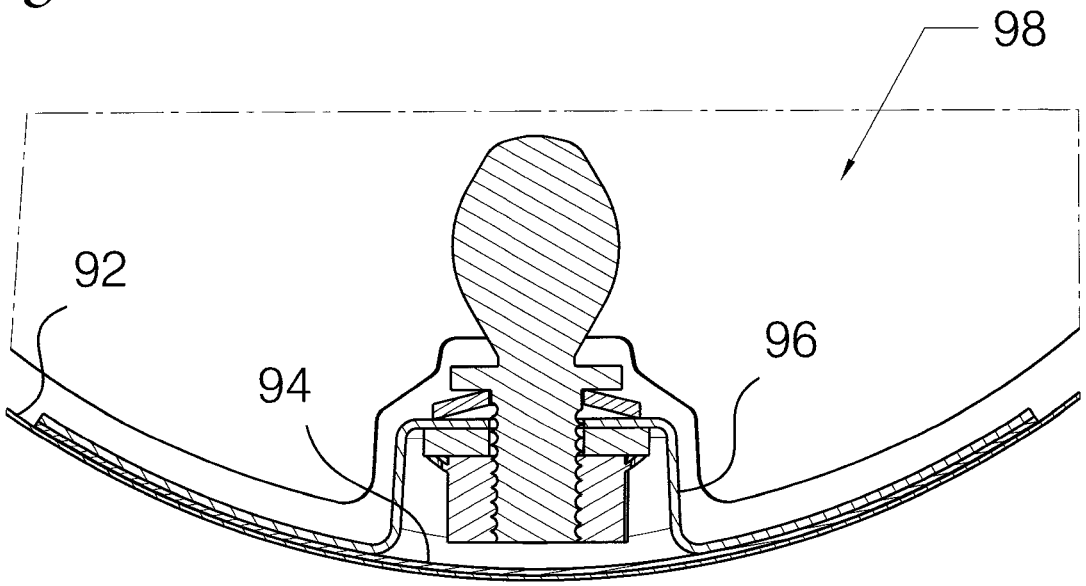
FIG. 9 illustrates a detailed cross-sectional view of FIG. 8.

FIGS. 8 and 9, another embodiment of the present invention wherein the volume damper Insert is mounted inside the air pipe with adhesive tape having glue on both sides and 82 (92), 84 (94), 86 (96) and 88 (98) are air pipes, tapes with adhesive on both sides, mounting brackets and volume damper assemblies respectively.

Figure 10:
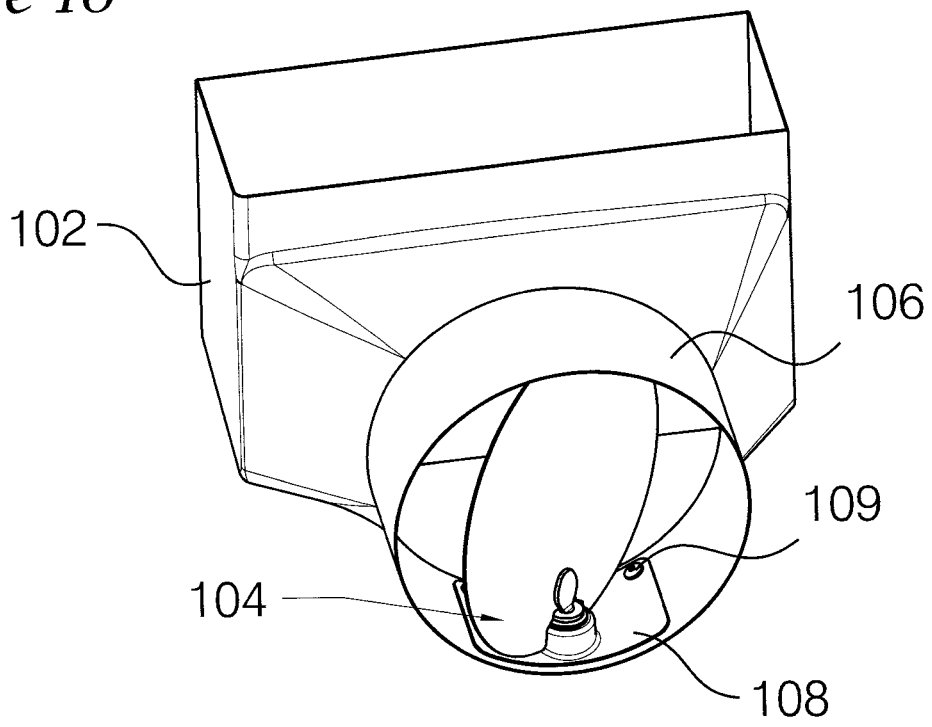
FIG. 10 illustrates the installation of the volume damper insert with mounting bracket in an air supply boot.

In FIG. 10, another embodiment of the present invention is depicted where the insert is mounted inside the air supply boot and 102, 104, 106, 108 and 109 are air supply boot, volume damper assembly, air supply boot collar, mounting bracket and mounting Screw respectively.

Figure 11:
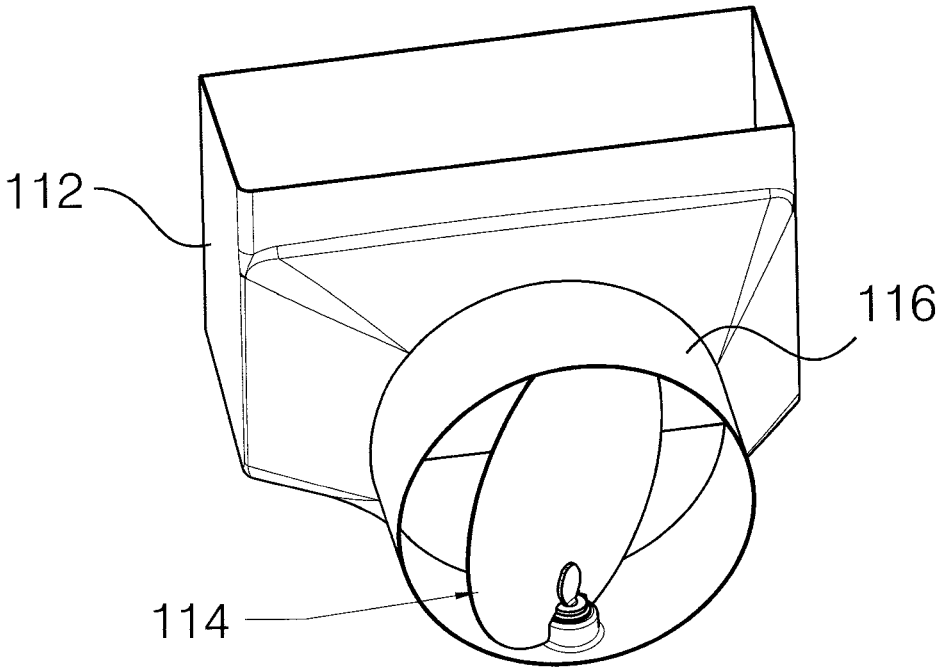
FIG. 11 illustrates another embodiment of the present invention installed in an air supply boot without the mounting bracket.
Figure 12:
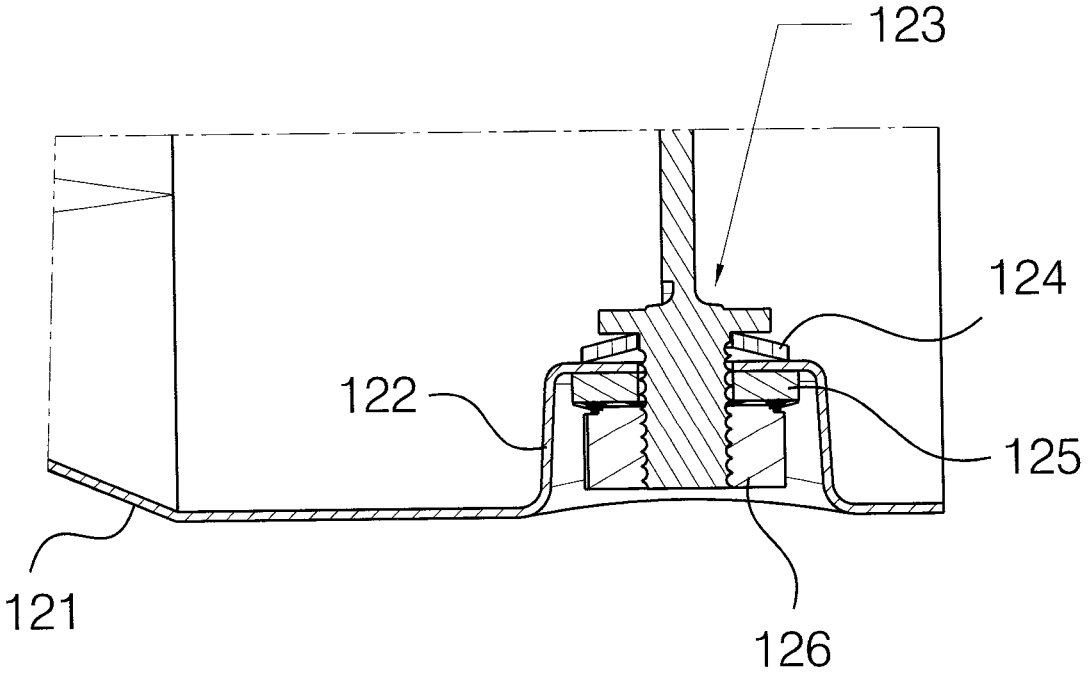
FIG. 12 illustrates a cross-sectional view of the portion of the air supply boot designed to engage the volume damper insert assembly without the mounting bracket.

In FIGS. 11 and 12, another embodiment of the present invention is illustrated. It shows the volume damper assembly 114 installed in an air supply boot 112. In this particular embodiment, the volume damper assembly 114 is installed without the mounting bracket. Instead of using the mounting bracket, the collar 116 of the air supply boot 112 is designed with a profile similar to that of the mounting bracket 32 shown in FIG. 3, as described previously wherein 121, 122, 123, 124, 125 and 126 are air supply boot, protruded profile (Already described in FIG. 3 and marked as 46), volume damper assembly, disc spring, spacer and K-lock nut respectively.

METHOD OF FIXING INSERT UNIT OF THE PRESENT INVENTION IN HVAC SYSTEM

The method comprising the steps of:

Remove the volume damper unit already installed.

Fasten the Insert with air supply pipe as shown in FIG. 7 with the help of screws and with the arrangements illustrated in FIGS. 8 and 10.

Alternatively, the air supply boot can be modified with arrangements shown in FIG. 11, where the profile of the mounting bracket has been incorporated into the collar of the air supply boot. In this case, there is no need for the extra process of installing the insert in the air supply line. The volume damper insert assembly and self-locking mechanism assembly will be incorporated therein.

In the foregoing illustrations and description, this Inventor has tried to resolve all major problems faced by the Service Engineers after installation of HVAC System in place, however there can be other possible arrangements obvious to the persons skilled in the maintenance industry. Embodiments described here are by way of examples only for the benefit of the persons of ordinary skill and not limiting the scope of present Inventions.

I claim:

1. A volume damper insert assembly configured to be installed and secured in an air supply boot, a pipe or a duct, said assembly comprising:

a damper blade having a profile;

a damper holder fixedly attached to the profile by means of rivets, welding, or other secure mechanical means, said damper holder comprising a threaded lower portion and a collar;

a locking mechanism configured to secure a rotational position of the damper blade, wherein the locking mechanism comprises a disc spring, a spacer, and a nut engaging the threaded lower portion of the damper holder; and a mounting bracket having a provision to allow the damper holder to pass through so as to support the disc spring and house the spacer and nut within the mounting bracket, wherein the nut is configured to compress the disc spring against the mounting bracket via the spacer to secure the rotational position of the damper blade, and wherein the profile of the damper blade accommodates the locking mechanism and the mounting bracket therewithin.

2. The assembly of claim 1, wherein the mounting bracket comprises a protrusion, said protrusion being accommodated in the profile of the damper blade.

3. The assembly of claim 2, wherein the protrusion is closer to one of longitudinal edge of the mounting bracket so as to keep the damper holder assembly within the pipe, and wherein holes for securing the volume damper insert assembly inside the pipe are on other longitudinal edge of the mounting bracket.

4. The assembly of claim 2, wherein the protrusion extends towards center axis of the pipe or the duct so as to house the spacer and the nut therewithin.

5. The assembly of claim 1, wherein the spacer is positioned between the nut and the bottom surface of the mounting bracket.

6. The assembly of claim 1, wherein the locking mechanism allows for the adjustment of the damper blade's rotational position by manipulating the profiled damper blade internally through the pipe or the duct, wherein the locking mechanism is configured to prevent unintended movement or rotation of the damper blade due to operational stresses or vibration.

7. The assembly of claim 1, wherein the nut is secured in its place by using a thread locking adhesive or is permanently secured to keep a defined constant axial compressive force on the disc washer so as to keep integrity of the locking mechanism.

8. The assembly of claim 1, wherein the damper holder is a slotted damper holder, said assembly is retained by a retainer washer.

9. The assembly of claim 1, wherein the mounting bracket is incorporated into the collar of an air supply boot or wall of the pipe or duct of an HVAC system.

10. The assembly of claim 1, wherein the mounting bracket is affixed to the collar of the air supply boot or wall of the pipe or duct of an HVAC system by means of adhesive tape thereby securing the assembly.

* * * * *